US009697998B2

(12) United States Patent
Nakamura et al.

(10) Patent No.: US 9,697,998 B2
(45) Date of Patent: Jul. 4, 2017

(54) MASS SPECTROMETER

(71) Applicant: CANON ANELVA CORPORATION, Kawasaki-shi (JP)

(72) Inventors: Megumi Nakamura, Kawasaki (JP); Yoshiyuki Takizawa, Kawasaki (JP); Masayuki Sugiyama, Kawasaki (JP); Yuji Shimada, Kawasaki (JP); Hiroki Mita, Kawasaki (JP)

(73) Assignee: CANON ANELVA CORPORATION, Kawasaki-Shi (JP)

( * ) Notice: Subject to any disclaimer, the term of this patent is extended or adjusted under 35 U.S.C. 154(b) by 0 days.

(21) Appl. No.: 14/980,824

(22) Filed: Dec. 28, 2015

(65) Prior Publication Data

US 2016/0240364 A1 Aug. 18, 2016

(30) Foreign Application Priority Data

Feb. 13, 2015 (JP) ..... 2015-026012

(51) Int. Cl.
*H01J 49/02* (2006.01)

(52) U.S. Cl.
CPC ..... *H01J 49/025* (2013.01)

(58) Field of Classification Search
CPC ..... H01J 49/02; H01J 49/022; H01J 49/025; H01J 49/24; H01J 49/26; G01T 1/20; G01T 1/24; G01T 1/28; G01T 1/29
See application file for complete search history.

(56) References Cited

U.S. PATENT DOCUMENTS

| | | | | |
|---|---|---|---|---|
| 6,091,068 | A * | 7/2000 | Parfitt | H01J 49/025 250/281 |
| 7,952,069 | B2 | 5/2011 | Shiokawa et al. | |
| 8,049,166 | B2 | 11/2011 | Shiokawa et al. | |
| 8,309,917 | B2 | 11/2012 | Shiokawa et al. | |
| 2009/0266979 | A1 | 10/2009 | Nakamura et al. | |
| 2013/0103337 | A1* | 4/2013 | Eiler | G06F 19/703 702/86 |
| 2013/0112868 | A1* | 5/2013 | Schwieters | H01J 49/025 250/282 |
| 2015/0262807 | A1 | 9/2015 | Nakamura et al. | |

* cited by examiner

*Primary Examiner* — David E Smith
(74) *Attorney, Agent, or Firm* — Fitzpatrick, Cella, Harper & Scinto

(57) ABSTRACT

A mass spectrometer includes: an ionization unit configured to ionize an analyte gas; a filter unit configured to allow passage of only a target ion which is a component of the analyte gas ionized in the ionization unit and which has a specific mass-to-charge ratio; and an ion detection unit configured to detect an ion detection value based on the target ion having passed through the filter unit, wherein the ion detection unit includes a Faraday electrode which includes an electrode portion disposed along a centerline of the filter unit and a bottom electrode provided at a position downstream of the electrode portion in a flow of the target ion, the electrode portion and the bottom electrode being connected to each other, a secondary electron multiplier provided to face the electrode portion with the centerline located therebetween, and a blocking portion connected to the bottom electrode.

10 Claims, 7 Drawing Sheets

MASS SPECTROMETER

CROSS-REFERENCES TO RELATED APPLICATIONS

This application is based upon and claims the benefit of priority of the prior Japanese Patent Application No. 2015-026012, filed Feb. 13, 2015. The contents of the aforementioned application are incorporated herein by reference in their entireties.

BACKGROUND OF THE INVENTION

Field of the Invention

The present invention relates to a mass spectrometer.

Description of the Related Art

A mass spectrometer having both a Faraday electrode (Faraday collector) and a secondary electron multiplier as its detectors is known. A mass spectrometer of this type can use the detectors selectively, as appropriate, according to the pressure of the measurement atmosphere, required sensitivity and stability, and the like. Namely, the mass spectrometer can use selectively, as appropriate, a mode (Faraday mode) in which the measurement is performed with the Faraday electrode and a mode (secondary electron multiplication mode) in which the measurement is performed with the secondary electron multiplier.

It is known that when a mass spectrometer of this type is used to perform measurement in a space with a pressure of $1\times10^{-2}$ Pa or higher, a large amount of vacuum ultraviolet light is generated upon ionization of an analyte gas in an ionization chamber. When the vacuum ultraviolet light reaches the ion detector and generates photoelectrons, the background increases in a mass spectrum obtained as a result of the mass spectrometry in either the Faraday mode or the secondary electron multiplication mode. The higher the pressure is, the more the vacuum ultraviolet light is generated, and the more likely the background is to increase.

In this respect, a configuration is known in which the Faraday electrode is not disposed on an axis of a mass spectrometry unit in addition to the secondary electron multiplier, which is not disposed on the axis. For example, a technology disclosed in U.S. Pat. No. 6,091,068 employs a structure in which an additional electrode is provided on an axis of a mass spectrometry unit to avoid the direct irradiation of a Faraday electrode with the vacuum ultraviolet light.

SUMMARY OF THE INVENTION

However, with the configuration in which the additional electrode is provided on the axis of the mass spectrometry unit as in the case of the technology of U.S. Pat. No. 6,091,068, the increase of the background is unavoidable, because the vacuum ultraviolet light reflected by the additional electrode is incident on the Faraday electrode or the secondary electron multiplier.

The present invention has been made in view of the above-described problems, and an object of the present invention is to provide a mass spectrometer which is capable of performing mass spectrometry on an analyte gas with a high precision, even when the analyte gas is placed in a space with a relatively high pressure.

A mass spectrometer according to an aspect of the present invention includes: an ionization unit configured to ionize an analyte gas; a filter unit configured to allow passage of only a target ion which is a component of the analyte gas ionized in the ionization unit and which has a specific mass-to-charge ratio; and an ion detection unit configured to detect an ion detection value based on the target ion having passed through the filter unit, wherein the ion detection unit includes a Faraday electrode which includes an electrode portion disposed along a centerline of the filter unit and a bottom electrode provided at a position downstream of the electrode portion in a flow of the target ion so as to intersect with the centerline, the electrode portion and the bottom electrode being connected to each other, a secondary electron multiplier provided to face the electrode portion with the centerline located therebetween, and a blocking portion connected to the bottom electrode and configured to block a photoelectron and reflected light traveling toward the secondary electron multiplier.

The present invention makes it possible to provide a mass spectrometer which is capable of performing mass spectrometry on an analyte gas with a high precision, even when the analyte gas is placed in a space with a relatively high pressure.

DESCRIPTION OF THE EMBODIMENTS

Hereinafter, embodiments of the invention of the present application will be described in detail with reference to the drawings. Note that the present invention is not limited to the embodiments below, and can be carried out in suitably modified forms within a range not departing from the gist of the present invention.

First Embodiment

Figure 1:
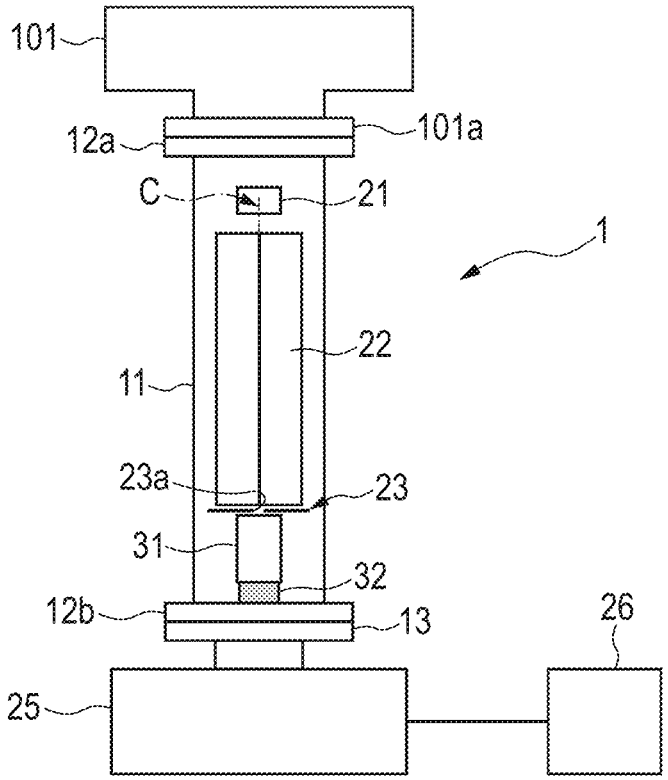
FIG. 1 is a schematic diagram of a mass spectrometer according to a first embodiment of the present invention.
Figure 2:
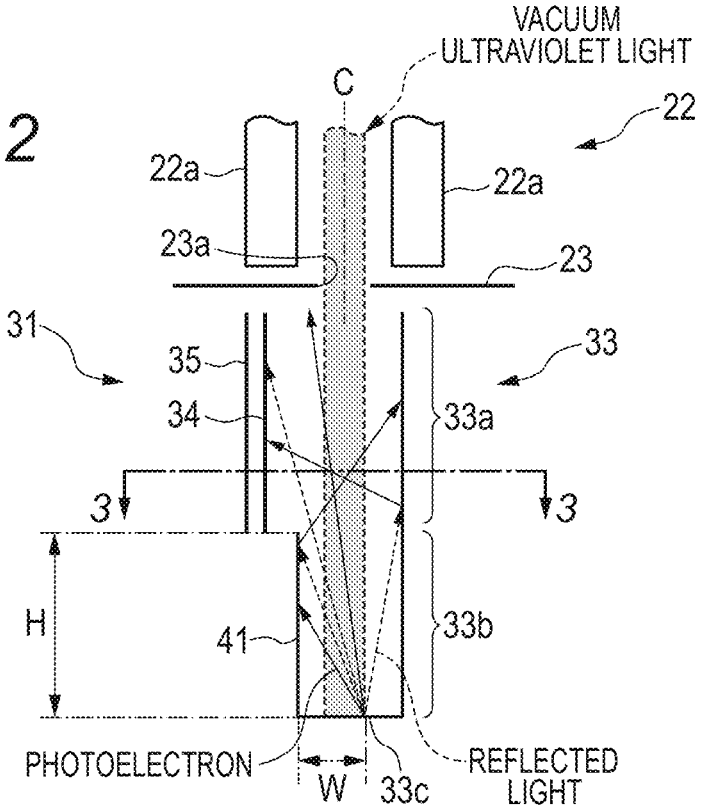
FIG. 2 is an enlarged diagram of an ion detection unit of FIG. 1.

FIG. 1 is a schematic structural diagram of a mass spectrometer according to a first embodiment. FIG. 2 is an enlarged diagram of an ion detection unit of the mass spectrometer shown in FIG. 1.

A mass spectrometer 1 according to the present embodiment is attached to a measurement target container 101, and performs mass spectrometry on a gas (analyte gas) inside (in a measurement space of) the measurement target container 101. The measurement target container 101 is provided with a flange 101*a* used for attaching the mass spectrometer 1. The measurement target container 101 is not limited to specific containers, and is, for example, a film formation chamber of a sputtering apparatus in which a film is formed. The mass spectrometer 1 makes it possible to perform mass spectrometry on the gas in the film formation chamber, for example, before, during, or after the film formation in the sputtering apparatus.

As shown in FIG. 1, the mass spectrometer 1 includes a nipple 11, which is a cylindrical member, for example. The mass spectrometer 1 includes an ion source (ionization unit) 21, a quadrupole (filter unit) 22, and an ion detector (ion detection unit) 31 inside the nipple 11. The mass spectrometer 1 further includes a controller 25 and an arithmetic unit 26.

The nipple (case) 11 is, for example, a cylindrical member provided with flanges 12*a* and 12*b* on both sides. The inside of the nipple 11 is configured to be capable of vacuum evacuation. Note that the case which houses the ion source 21, the quadrupole 22, and the ion detector 31 does not necessarily have to be the nipple 11, which is a cylindrical member, and cases in various shapes can be used.

Of the two flanges 12*a* and 12*b* of the nipple 11, the flange 12*a* is a connection portion used for attachment to the measurement target container 101 to be measured. The flange 12*a* is connected to the flange 101*a* provided to the measurement target container 101. During measurement, the inside of the nipple 11 is made continuous to the inside of the measurement target container 101 through a connection portion of the flanges 12*a* and 101*a*, and the gas in the nipple 11 and the gas in the measurement target container 101 are made uniform in terms of the pressure and components. The pressure of a space inside the measurement target container 101 is, for example, $1\times10^{-2}$ Pa or higher, and the pressure of a space inside the nipple 11 made continuous to the inside of the measurement target container 101 is also $1\times10^{-2}$ Pa or higher.

The flange 12*b* is connected to a base flange 13 attached to the controller 25. The ion source (ionization unit) 21, the quadrupole 22, and the ion detector (ion detection unit) 31 are connected to the controller 25 disposed outside the base flange 13 through wiring. The controller 25 is further connected to the arithmetic unit (computer) 26.

The ion detector 31 is fixed to a surface of the base flange 13 inside the nipple 11 with an insulating material 32 provided therebetween. On an opposite side of the ion detector 31 from an end portion to which the base flange 13 is attached, the quadrupole 22 and a quadrupole exit aperture plate 23 are fixed with an unillustrated insulating material. The quadrupole exit aperture plate 23 is provided between the quadrupole 22 and the ion detector 31, and has an aperture 23*a* which allows the passage of predetermined ions from the quadrupole 22 side to the ion detector 31 side as described later. Moreover, the ion source 21 is attached by an unillustrated insulating material on the opposite side of the quadrupole 22 from the end portion to which the ion detector 31 is attached.

The ion source 21 is an ionization unit configured to ionize an analyte gas in the measurement target container 101. The ion source 21 ionizes the analyte gas flowing from the inside of the measurement target container 101 into the ion source 21 in the nipple 11. Note that the ion source 21 is not limited to an ion source based on a specific ionization method. Ion sources based on various ionization methods such as the electron ionization method can be used as the ion source 21. Components of the analyte gas ionized in the ion source 21 exit from the ion source 21 and enter the quadrupole 22.

The quadrupole 22 is a filter unit configured to allow selective passage of target ions which have a preset specific mass-to-charge ratio out of ions in the analyte gas ionized in the ion source 21. The quadrupole 22 is positioned between the ion source 21 and the ion detector 31. The quadrupole 22 includes four rods 22*a* (see FIG. 2), which are cylindrical metal electrodes. The rods 22*a* are arranged in parallel with each other along a central axis (centerline) C on a circle centered at the central axis C at regular intervals. The quadrupole 22 is connected to an electronic circuit in the controller 25 which applies a voltage in which a direct-current voltage and an alternating voltage at a specific frequency are superimposed to each rod 22*a*. By controlling the voltage applied to each rod 22*a*, it is possible to allow the passage of only target ions having a predetermined mass-to-charge ratio to the ion detector 31 side, which is a downstream side. Moreover, by sweeping the voltage, the mass-to-charge ratio of the target ions which are allowed to pass can be changed.

FIG. 2 shows the ion detector 31 in an enlarged manner. FIG. 2 is an enlarged schematic diagram of a portion of the mass spectrometer 1 shown in FIG. 1 including the ion detector 31. The ion detector 31 is an ion detection unit which detects the target ions of the analyte gas having passed through the quadrupole 22 serving as the filter unit, and detects an electric current value (ion detection value) based on the target ions. The ion detector 31 includes a Faraday electrode (Faraday collector) 33, a secondary electron multiplier 34, and an electron collector 35. The Faraday electrode 33, the secondary electron multiplier 34, and the electron collector 35 are provided to the base flange 13 with the insulating material 32 provided therebetween. The secondary electron multiplier 34 is disposed between the Faraday electrode 33 and the electron collector 35.

The Faraday electrode 33 is disposed downstream of the quadrupole 22 along the centerline C of the quadrupole 22. The Faraday electrode 33 includes an electrode portion 33*a* (first electrode), an extension portion 33*b* (second electrode), and a bottom electrode 33*c* (third electrode). The electrode portion 33*a* is disposed along the centerline C. The extension portion 33*b* is disposed along the centerline C at a position downstream of the electrode portion 33*a* in a flow of the target ions. The bottom electrode 33*c* is provided at a position downstream of the extension portion 33*b* in the flow of the target ions so as to intersect with the centerline C, for example, perpendicularly to the centerline C. The electrode portion 33*a* and the extension portion 33*b* are integrally formed. The bottom electrode 33*c* is integrally connected to the extension portion 33*b*. In addition, a block plate 41 (a blocking portion, fourth electrode) is integrally connected to the bottom electrode 33*c*. In this manner, the electrode portion 33*a*, the extension portion 33*b*, and the bottom electrode 33*c* of the Faraday electrode 33, and the block plate 41 are integrally connected, and electrically connected to each other.

The electrode portion 33*a* is a plate member provided in parallel with the centerline C and surrounding the centerline C in three directions, and has an opening in a portion facing the secondary electron multiplier 34. Namely, the electrode portion 33*a* surrounds three of the four sides of the centerline C except for one side facing the secondary electron multiplier 34, and has an opening portion on the one side facing the secondary electron multiplier 34.

The extension portion 33*b* is a plate member formed by extending the electrode portion 33*a* on the downstream side in the flow of the target ions of the analyte gas along the centerline C. As in the case of the electrode portion 33*a*, the extension portion 33*b* is a plate member which is provided in parallel with the centerline C and which surrounds the centerline C in three directions. The block plate 41 is connected to a portion of the extension portion 33*b* facing a downstream side of the secondary electron multiplier 34. Namely, the extension portion 33*b* surrounds three of the four sides of the centerline C except for one side facing the downstream side of the secondary electron multiplier 34, and the block plate 41 is provided on the one side facing the downstream side of the secondary electron multiplier 34. The bottom electrode 33*c* is connected to downstream-side end portions of the extension portion 33*b* and the block plate 41. The bottom electrode 33*c* is provided so as to intersect with the centerline C, for example, perpendicularly intersect with the centerline C. In this manner, the block plate 41 is connected to the electrode portion 33*a* through the extension portion 33*b* and the bottom electrode 33*c*, and is formed integrally with the Faraday electrode 33. The block plate 41 is electrically connected to the Faraday electrode 33.

The block plate 41 is an electrically conductive member configured to block photoelectrons which are generated at the bottom electrode 33*c* and then travel toward the secondary electron multiplier 34 and to block reflected light which is reflected by the bottom electrode 33*c* and then travels toward the secondary electron multiplier 34. The block plate 41 is provided in parallel with the centerline C.

When the pressure of the spaces inside the measurement target container 101 and the nipple 11 made continuous to each other is a relatively high pressure of, for example, $1\times10^{-2}$ Pa or higher, a large amount of vacuum ultraviolet light may be generated upon the ionization of the analyte gas in the ion source 21. The generated vacuum ultraviolet light enters the ion detector 31. The bottom electrode 33*c* of the Faraday electrode 33 is irradiated with the vacuum ultraviolet light having entered the ion detector 31. The irradiation of the bottom electrode 33*c* with the vacuum ultraviolet light results in generation of photoelectrons at the bottom electrode 33*c*. In addition, the vacuum ultraviolet light is reflected by the bottom electrode 33*c* to form reflected light. In FIG. 2 and in FIGS. 4, 6 to 9, 11, and 12 shown later, photoelectrons are schematically shown by solid arrows, and rays of the reflected light are schematically shown by dashed arrows.

The block plate 41 blocks the reflected light and the photoelectrons generated because of the irradiation with the vacuum ultraviolet light as described above, and reduces photoelectrons and reflected light reaching the secondary electron multiplier 34. In addition, the block plate 41 can absorb the blocked photoelectrons. Note that, although the block plate 41, which is a plate-shaped member, is used in the present embodiment, electrically conductive members in various shapes can be used instead of the block plate 41, as long as the members can block the photoelectrons and reflected light in the same manner as in the case of the block plate 41.

Figure 3:
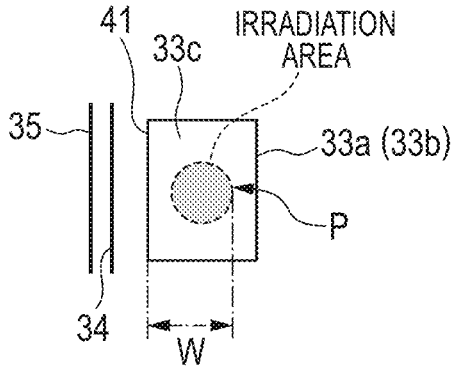
FIG. 3 is a cross-sectional diagram taken along the line 3-3 of FIG. 2 in the direction of the arrows 3 of FIG. 2.

In the present embodiment, the electrode portion 33*a*, the extension portion 33*b*, the bottom electrode 33*c*, and the block plate 41 are formed as an integrated electrode. When the target ions come into contact with any of these electrodes, an ion current can be detected. Note that, although the block plate 41 is formed of the plate-shaped member in the present embodiment, electrically conductive members having various shapes can be used instead of the block plate 41, as long as the members can block the photoelectrons and reflected light. Moreover, although the block plate 41 is a flat plate-shaped member, the block plate 41 may be curved to follow the shape of the irradiated area with the vacuum ultraviolet light cast on the bottom electrode 33*c*. For example, FIG. 3 shows a circular irradiated area as the irradiated area with the vacuum ultraviolet light cast on the bottom electrode 33*c*. In this case, the block plate 41 may be a partial cylinder-shaped member curved along a periphery of the irradiated area.

The secondary electron multiplier 34 is, for example, a micro-channel plate. The secondary electron multiplier 34 has an input surface on which the target ions are incident and an output surface through which multiplied electrons are emitted. The secondary electron multiplier 34 is configured to convert the target ions incident on the input surface into electrons, multiply the electrons, and emit the multiplied electrons through the output surface. The secondary electron multiplier 34 is provided to face the electrode portion 33*a* of the Faraday electrode 33. Namely, the secondary electron multiplier 34 is provided in such a manner that the input surface faces the opening portion of the electrode portion 33*a* of the Faraday electrode 33 with the centerline C located therebetween. In addition, the electron collector 35 is provided to face the output surface of the secondary electron multiplier 34. Note that the secondary electron multiplier 34 is not limited to a micro-channel plate. Alternatively, the secondary electron multiplier 34 may be, for example, a channel-type secondary electron multiplier or a multi stage-type secondary electron multiplier.

The mass spectrometer 1 according to the present embodiment can selectively use two modes, namely, a Faraday mode in which the measurement is performed with the Faraday electrode 33 and a secondary electron multiplication mode in which the measurement is performed with the secondary electron multiplier 34.

First, in the case of the Faraday mode where the target ions having passed through the quadrupole 22 are directly detected with the Faraday electrode 33, the Faraday electrode 33 is connected to an electrometer in the controller 25 to measure an electric current value (ion detection value) associated with the incidence of the target ions.

On the other hand, in the case of the secondary electron multiplication mode where the target ions are multiplied by the secondary electron multiplier 34 and then detected, the Faraday electrode 33 is used as an auxiliary electrode by applying a positive electric potential thereto, as appropriate. With this application, a negative high-voltage is applied to a portion of the secondary electron multiplier 34 facing the Faraday electrode 33. Thus, the ions are attracted to the secondary electron multiplier 34, in which the ions are converted into electrons, and further the electrons are multiplied. Then, the electrons multiplied and emitted through the output surface are caused to be incident on the electron collector 35 connected to the electrometer in the controller 25, and are measured as an electric current value (ion detection value) which reflects the amount of the ions detected.

In the present embodiment, the block plate 41 is provided to the bottom electrode 33*c*, which is a bottom portion of the Faraday electrode 33. Consequently, it is possible to cause the block plate 41 to absorb photoelectrons which are generated at the bottom portion of the Faraday electrode 33 upon the irradiation with the vacuum ultraviolet light. Without this block plate 41, the generated photoelectrons would be then leaked to the outside of the Faraday electrode 33. Since the block plate 41 is electrically connected to the Faraday electrode 33, change in a charge state of the Faraday electrode 33 due to the generation of the photoelectrons can be reduced by absorbing the photoelectrons by the block plate 41. When the Faraday mode is employed, this makes it possible to reduce the noises, suppress the increase of the background in a mass spectrum, and carry out the measurement with a high precision.

In addition to the effect of reducing the photoelectrons, the block plate 41 also has an effect of reducing the amount of vacuum ultraviolet light reaching the secondary electron multiplier 34 by reflecting the vacuum ultraviolet light on its surface. Namely, the block plate 41 blocks the photoelectrons and reflected light generated because of the irradiation with the vacuum ultraviolet light, and reduces photoelectrons and reflected light reaching the secondary electron multiplier 34. For this reason, also when the secondary electron multiplier mode is employed, it is possible to reduce the noises, suppress the increase of the background in a mass spectrum, and carry out the measurement with a high precision.

In this manner, the present embodiment makes it possible to reduce the noises, suppress increase of the background in a mass spectrum, and carry out mass spectrometry with a high detection limit and a high precision, even in the case of an analyte gas in a space with a relatively high pressure. For example, the mass spectrometry can be carried out with a high precision even on an analyte gas in a space with a relatively high pressure of $1\times10^{-2}$ Pa or higher.

FIG. 3 shows a cross-sectional diagram taken along the line 3-3 of FIG. 2 in the direction of the arrows 3 of FIG. 2. This 3-3 cross section is a cross section perpendicular to the centerline C. FIG. 3 shows an area (irradiated area) where the bottom electrode 33*c*, which is the bottom portion of the Faraday electrode 33, is irradiated with the vacuum ultraviolet light. The irradiated area with the vacuum ultraviolet light is, for example, a precisely circular region. Regarding the irradiated area with the vacuum ultraviolet light, a ratio of a distance W between the block plate 41 and a position P which is on a periphery of the irradiated area with the vacuum ultraviolet light and which is the most away from the block plate 41 (a distance W between the block plate 41 and an irradiated area peripheral portion) to a height H of the block plate 41 (see FIG. 2) can be, for example, about 1:10. It is conceivable that this makes it possible to absorb photoelectrons generated in the irradiated area with the vacuum ultraviolet light by the block plate 41. Namely, the height H of the block plate 41 can be set to be about 10 times or 10 or less times the distance W between the block plate 41 and the position P on the periphery of the irradiated area. Note that the distance W is a distance along a plane perpendicular to the centerline C. In addition, from the viewpoint of effectively absorbing the photoelectrons, the height H of the block plate 41 is preferably 8 or more times the distance W between the block plate 41 and the position P on the periphery of the irradiated area.

Second Embodiment

Figure 4:
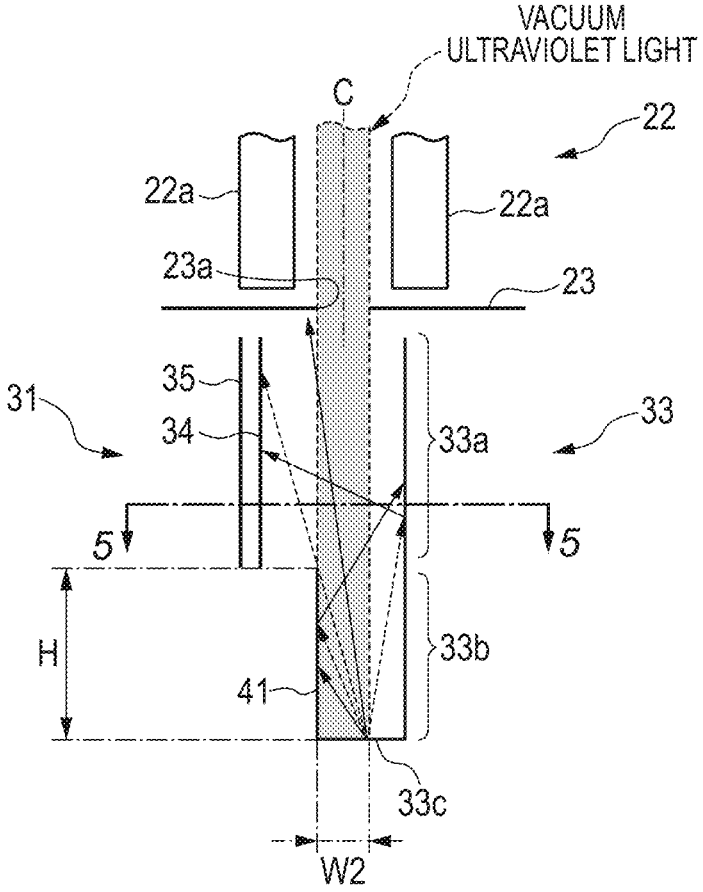
FIG. 4 is an enlarged diagram of an ion detection unit according to a second embodiment of the present invention.
Figure 5:
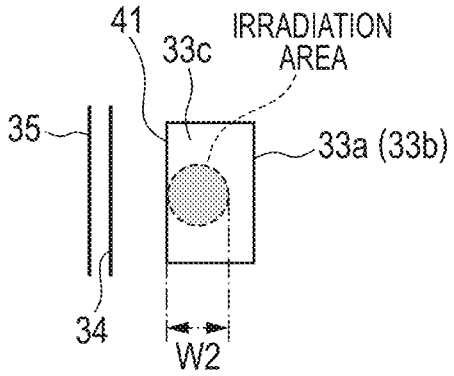
FIG. 5 is a cross-sectional diagram taken along the line 5-5 of FIG. 4 in the direction of the arrows 5 of FIG. 4.

FIGS. 4 and 5 show a second embodiment. Each of the following embodiments is a configuration example which differs from the first embodiment mainly in the structure of the ion detector. In each of the following embodiments, components similar to those in the first embodiment are denoted by the same reference numerals, and descriptions thereof are omitted.

The present embodiment has a configuration in which a position at which the block plate 41 stands (a position at which the block plate 41 and the bottom electrode 33*c* are connected to each other) is made closer to the irradiated area with the vacuum ultraviolet light. FIG. 5 shows a cross-sectional diagram taken along the line 5-5 of FIG. 4 in the direction of the arrows 5 of FIG. 4. This 5-5 cross section is a cross section perpendicular to the centerline C. As shown in FIG. 4, the closer to the irradiated area of the bottom portion of the Faraday electrode 33 with the vacuum ultraviolet light the position at which the block plate 41 stands is, the lower the height of the block plate 41 can be, and the greater a contribution made to the miniaturization of the ion detector 31 can be.

For example, the position at which the block plate 41 stands can be set at a boundary of the irradiated area of the bottom electrode 33*c*, which is the bottom portion of the Faraday electrode 33, with the vacuum ultraviolet light. FIGS. 4 and 5 show a case where the position at which the block plate 41 stands is set at a boundary of the irradiated area where the bottom electrode 33*c* is irradiated with the vacuum ultraviolet light as described above. When the position at which the block plate 41 stands is set in this manner, the height H of the block plate 41 can be 10 or less times a width W2 (illustrated in FIG. 5) of the irradiated area of the bottom portion of the Faraday electrode 33 with the vacuum ultraviolet light. Note that the width W2 of the irradiated area with the vacuum ultraviolet light refers to a width of the irradiated area with the vacuum ultraviolet light in a direction perpendicular to the block plate 41 on the 5-5 cross section perpendicular to the centerline C. In this case, photoelectrons generated in the irradiated area with the vacuum ultraviolet light can be absorbed by the block plate 41, and a sufficient effect to suppress the increase of the background is achieved. Note that the height H of the block plate 41 is preferably 8 or more times the width W2 of the irradiated area with the vacuum ultraviolet light from the viewpoint of effectively absorbing the photoelectrons.

Figure 6:
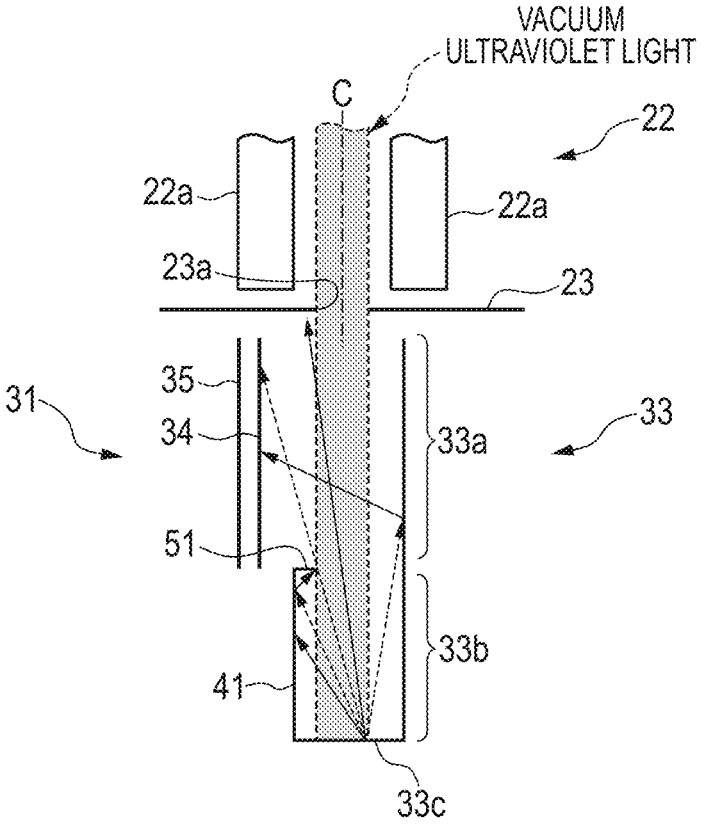
FIG. 6 is an enlarged diagram of an ion detection unit according to a modification (part 1) of the second embodiment of the present invention.

FIG. 6 is an enlarged diagram of an ion detection unit according to a modification (part 1) of the second embodiment. Also when an electrically conductive returning portion 51 is attached to an upper portion of the block plate 41 as shown in FIG. 6, the same effects as those of the configuration of FIGS. 4 and 5 can be achieved. In FIG. 6, the returning portion 51 is attached to the upper portion of the block plate 41 provided in the same manner as in the case shown in FIG. 2 so as to project toward the centerline C up to a boundary of the vacuum ultraviolet light. Note that the returning portion 51 may be provided integrally with the block plate 41 or may be provided as a separate member. In addition, the returning portion 51 does not necessarily have to reach the boundary of the vacuum ultraviolet light. Even when the returning portion 51 does not reach the boundary of the vacuum ultraviolet light, the returning portion 51 can effectively block the photoelectrons and reflected light effectively.

Figure 7:
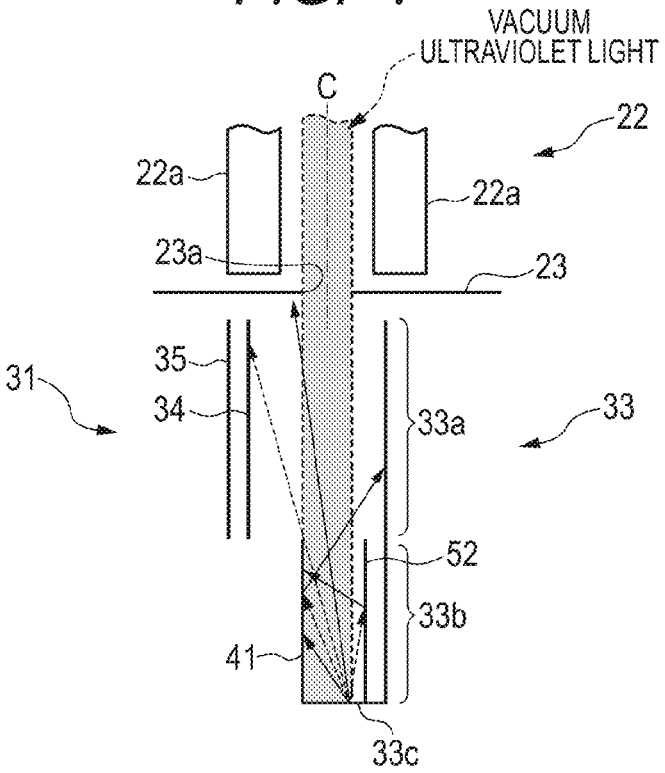
FIG. 7 is an enlarged diagram of an ion detection unit according to another modification (part 2) of the second embodiment of the present invention.

FIG. 7 is an enlarged diagram of an ion detection unit according to another modification (part 2) of the second embodiment. In FIG. 7, a second block plate 52 which is an electrically conductive flat plate-shaped member is provided as another blocking portion on a closed side of the Faraday electrode 33, in addition to the block plate 41 serving as a blocking portion.

The second block plate 52 is provided on the bottom electrode 33*c* so as to face the block plate 41 with the centerline C located therebetween within the extension portion 33*b* of the Faraday electrode 33. By providing the second block plate 52 in this manner, the photoelectrons based on the reflected light can also absorbed by the block plate 41. Specifically, photoelectrons are generated, when the second block plate 52 is irradiated with the reflected light formed by the reflection of the vacuum ultraviolet light on the bottom electrode 33*c*. The generated photoelectrons are absorbed by the block plate 41 facing the second block plate 52. Without the second block plate 52, photoelectrons are generated upon irradiation of the electrode portion 33*a* or the extension portion 33*b* of the Faraday electrode 33 with the reflected light, and the thus generated photoelectrons cannot be absorbed by the block plate 41 in some cases. The provision of the second block plate 52 makes it possible to reduce such photoelectrons which cannot be absorbed by the block plate 41. In this manner, the configuration shown in FIG. 7 makes it possible to enhance the effect of suppressing the increase of the background, when the Faraday mode is employed.

Note that FIG. 7 shows the case where the second block plate 52 is provided together with the block plate 41 shown in FIGS. 4 and. 5. Alternatively, the second block plate 52 may be provided together with the block plate 41 shown in FIGS. 2 and 3 or the block plate 41 to which the returning portion 51 is attached as shown in FIG. 6.

Figure 8:
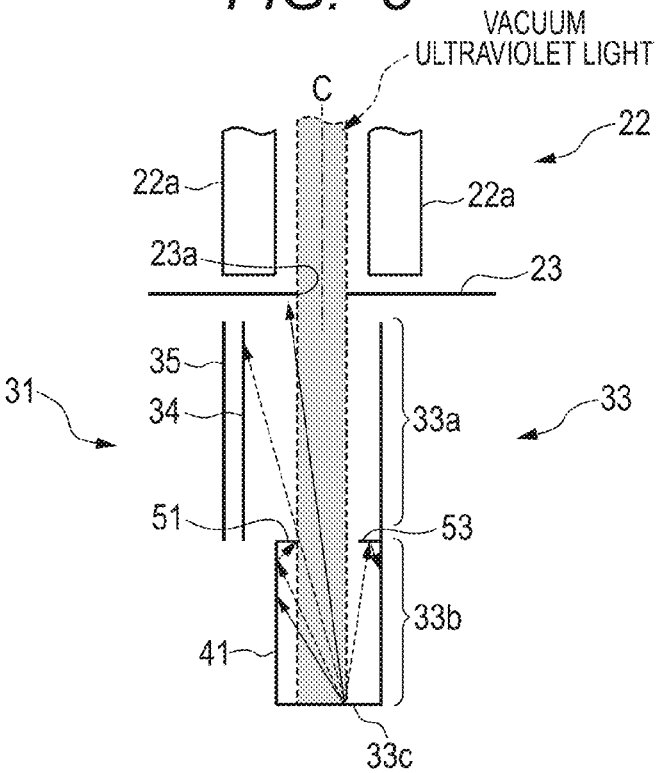
FIG. 8 is an enlarged diagram of an ion detection unit according to still another modification (part 3) of the second embodiment of the present invention.

FIG. 8 is an enlarged diagram of an ion detection unit according to still another modification (part 3) of the second embodiment. FIG. 8 shows a case where an electrically conductive second returning portion 53 is provided instead of the second block plate 52 at a position equivalent to an upper portion of the second block plate 52. The configuration shown in FIG. 8 can also achieve the same effects as those achieved by the configuration shown in FIG. 7. In FIG. 8, the second returning portion 53 is attached to the electrode portion 33*a* or the extension portion 33 of the Faraday electrode 33 on the inside, i.e., on the side closer to the block plate 41, so as to project toward the block plate 41, i.e., toward the centerline C. In this case, photoelectrons generated upon irradiation of the second returning portion 53 can be absorbed by the Faraday electrode 33. Note that the second returning portion 53 may be provided integrally with the electrode portion 33*a* or the extension portion 33*b* of the Faraday electrode 33, or may be provided as a separate member. Note that the second returning portion 53 of FIG. 8 is attached to a position facing the returning portion 51 attached to the upper portion of the block plate 41.

Note that FIG. 8 shows the case where the second returning portion 53 is attached together with the block plate 41 to which the returning portion 51 is attached as shown in FIG. 6. Alternatively, the second returning portion 53 may be provided together with the block plate 41 shown in FIGS. 2 and 3 or the block plate 41 shown in FIGS. 4 and 5. The second returning portion 53 may be attached to the second block plate 52.

Third Embodiment

Figure 9:
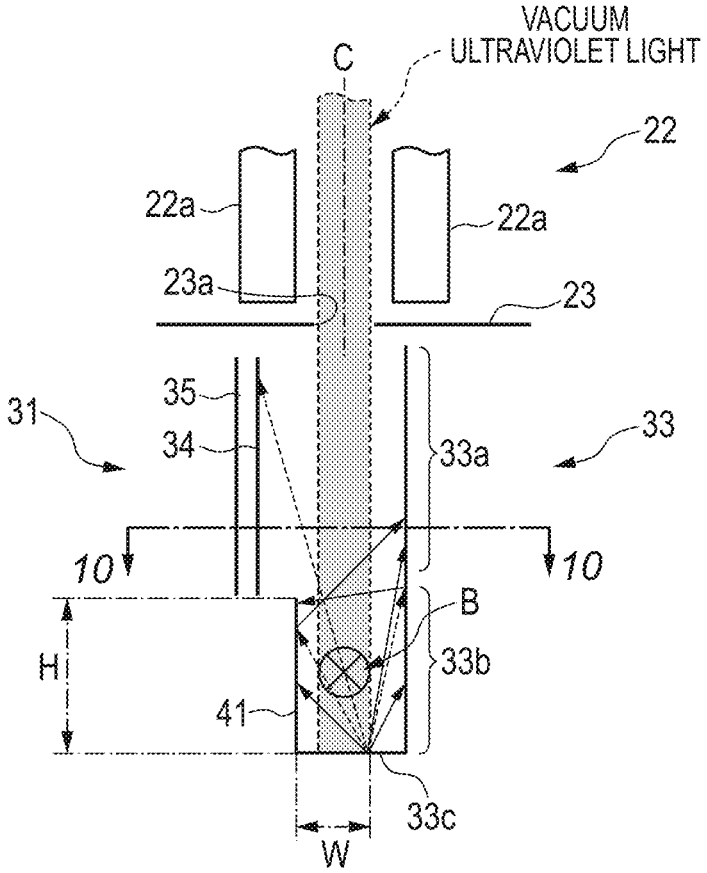
FIG. 9 is an enlarged diagram of an ion detection unit according to a third embodiment of the present invention.
Figure 10:
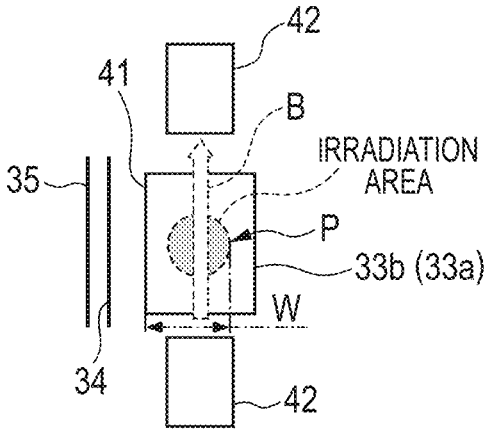
FIG. 10 is a cross-sectional diagram taken along the line 10-10 of FIG. 9 in the direction of the arrows 10 of FIG. 9.

FIG. 9 is an enlarged diagram of an ion detection unit according to a third embodiment, and FIG. 10 is a cross-sectional diagram taken along the line 10-10 of FIG. 9 in the direction of the arrows 10 of FIG. 9. This 10-10 cross section is a cross section perpendicular to the centerline C. The present embodiment further includes a magnet unit configured to apply a magnetic field for causing photoelectrons to be incident on the electrode portion 33*a* and the extension portion 33*b* of the Faraday electrode 33 to a space between the block plate 41 and the Faraday electrode 33.

As shown in FIGS. 9 and 10, a pair of permanent magnets 42 serving as a magnet unit configured to apply a magnetic field B is provided on both sides of the extension portion 33*b* of the Faraday electrode 33, where the block plate 41 side is taken as a front side. The pair of permanent magnets 42 applies the magnetic field B in a direction from the near side to the far side on the paper to a space between the pair of permanent magnets 42 including a space surrounded by the extension portion 33*b* in front of the block plate 41. Namely, the pair of permanent magnets 42 applies the magnetic field B to the space between the pair of permanent magnets 42 including the space surrounded by the extension portion 33*b* in parallel with the surface (blocking surface) of the block plate 41 irradiated with the photoelectrons and reflected light and in such a direction that the secondary electron multiplier 34 and the block plate 41 are located on the left in the top view from the side of the quadrupole (filter unit) 22. Note that the direction in which the magnetic field B is applied is, for example, perpendicular to the centerline C. In this manner, the pair of permanent magnets 42 is provided to cause magnetic lines of force of the magnetic field B to pass in parallel with the blocking surface of the block plate 41 and in such a direction that the secondary electron multiplier 34 and the block plate 41 are located on the left in a top view from the side of the quadrupole (filter unit) 22.

In the present embodiment, a path of the photoelectrons is curved by the application of the magnetic field B with the pair of permanent magnets 42 as described above. In this manner, the photoelectrons can be caused to be incident on the electrode portion 33*a* and the extension portion 33*b* of the Faraday electrode 33 present at the position facing the block plate 41. Consequently, the height H of the block plate 41 can be reduced, enabling the miniaturization of the mass spectrometer. For example, when a magnetic field of about 40 gauss is applied as the magnetic field B, the height H of the block plate 41 can be set to be 1.5 to 3 times the distance W between the block plate 41 and the position P which is on the periphery of the irradiated area with the vacuum ultraviolet light and which is the most away from the block plate 41.

In addition, in FIG. 10, the pair of permanent magnets 42 is shown as a configuration example of the magnets. However, the magnet unit configured to apply the magnetic field B may be constituted of only one magnet. In addition, the magnet unit may be either a permanent magnet unit or an electromagnet unit.

Note that the magnet unit configured to apply the magnetic field B as described above can be provided not only in the configuration according to the first embodiment, but also in the configuration according to any one of the second embodiment and the modifications thereof. Note that, in the case of the configuration having the second block plate 52, the path of the photoelectrons can be curved by applying the magnetic field B to cause the photoelectrons to be incident on the second block plate 52.

Fourth Embodiment

Figure 11:
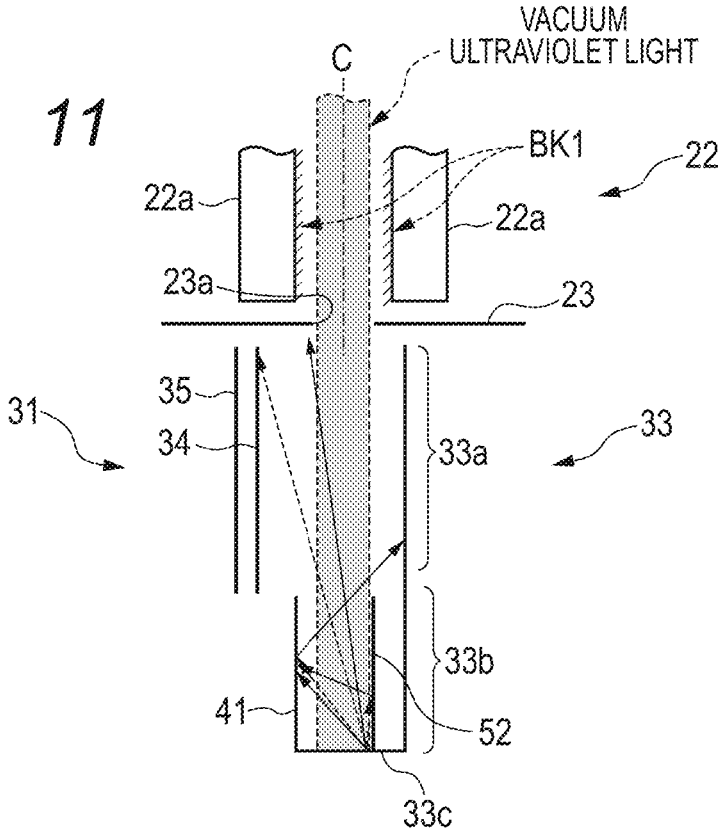
FIG. 11 is an enlarged diagram of an ion detection unit according to a fourth embodiment of the present invention.

FIG. 11 is an enlarged diagram of an ion detection unit according to a fourth embodiment. As shown in FIG. 11, the inside of the quadrupole 22 is blackened by coloring the inside of the quadrupole 22 in black by black plating, oxidation treatment, carbon vapor deposition treatment, or the like, while retaining electrical conductivity. This is also effective to suppress the increase of the background.

An example of blackened portions in the quadrupole 22 is shown as blackened portions BK1 in FIG. 11. As shown in FIG. 11, at least inside surfaces of the rods 22*a*, which are the electrodes constituting the quadrupole 22, are blackened to form the blackened portions BK1, while retaining electrical conductivity. The blackening of the inside surfaces of the rods 22*a* of the quadrupole 22 as described above makes it possible to reduce the vacuum ultraviolet light which is reflected on the surfaces of the rods 22*a* of the quadrupole 22 and with which the Faraday electrode 33 is irradiated. The reduction of the vacuum ultraviolet rays in this manner makes it possible to reduce the noises and suppress the increase of the background in a mass spectrum. In addition, since the irradiated area with the vacuum ultraviolet light can be limited to a narrower area, the height H of the block plate 41 can be reduced, enabling the miniaturization of the mass spectrometer.

Figure 12:
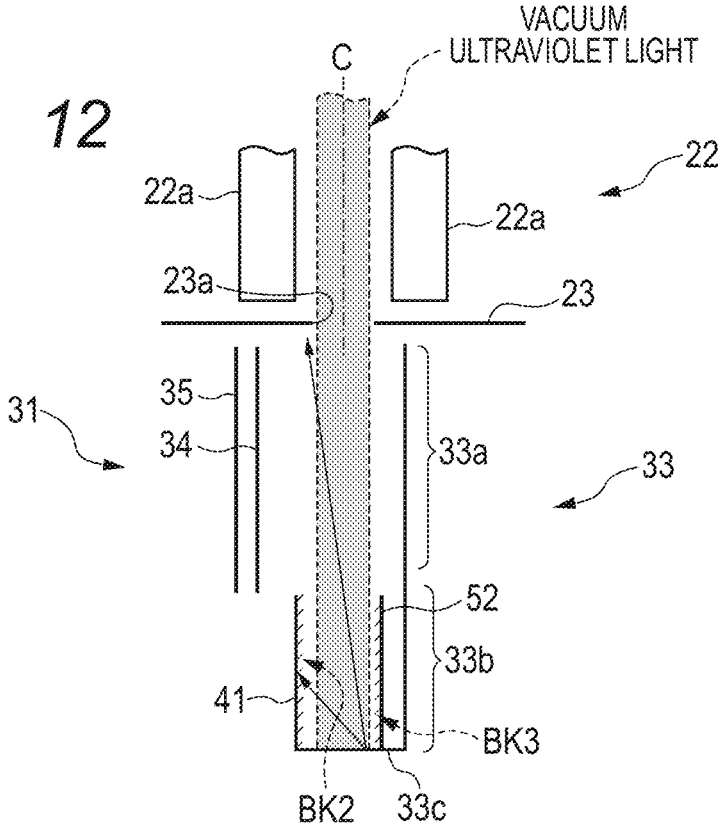
FIG. 12 is an enlarged diagram of an ion detection unit according to a modification of the fourth embodiment of the present invention.

FIG. 12 shows a modification of the fourth embodiment. Other examples of the blackened portions are shown as blackened portions BK2 and BK3 in FIG. 12. In the case shown in FIG. 11, the inside surfaces of the rods 22*a* of the quadrupole 22 at which the quadrupole 22 is irradiated with the vacuum ultraviolet light are colored in black, while retaining electrical conductivity. As shown in FIG. 12 described below, other portions which are irradiated with the vacuum ultraviolet light may be blackened by being colored in black, while retaining electrical conductivity.

In the case shown in FIG. 12, a surface of the block plate 41 on the Faraday electrode 33 side is blackened to form the blackened portion BK2 by black plating, oxidation treatment, carbon vapor deposition treatment, or the like, while retaining electrical conductivity. In addition, a surface of the second block plate 52 on the block plate 41 side is blackened to from the blackened portion BK3 by black plating, oxidation treatment, carbon vapor deposition treatment, or the like, while retaining electrical conductivity. The blackening achieved by coloring the surfaces of the block plates 41 and 52 which are irradiated with the vacuum ultraviolet light in black as described above makes it possible to further reduce the reflected vacuum ultraviolet light which is reflected on the surfaces of the block plates 41 and 52 and which reaches the secondary electron multiplier 34. This makes it possible to suppress the increase of the background, and carry out the measurement with a high precision, when the secondary electron multiplication mode is employed.

Figure 13:
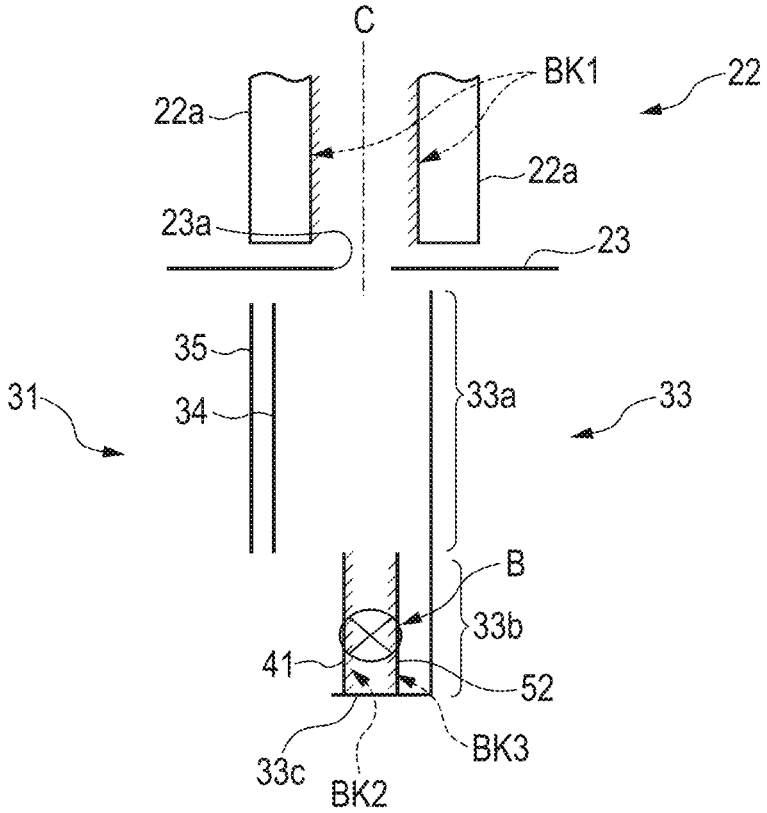
FIG. 13 is an enlarged diagram of an ion detection unit according to a modification of each embodiment of the present invention.

FIG. 13 shows a modification of the above-described embodiment. As shown in FIG. 13, it is possible to carry out a combination of the provision of the block plate 41, the provision of the second block plate 52, the provision of the magnet unit configured to apply the magnetic field B, the blackening of the inside surfaces of the quadrupole 22 (the blackened portions BK1), and the blackening of the block plates 41 and 52 (blackened portions BK2 and BK3). As a result, the effects of these constituents can be exhibited synergistically. Note that a combination of any ones of the configurations shown in the above-described first to fourth embodiments and the modifications thereof can be carried out.

Although the mass spectrometer of the present invention has a relatively simple structure, the mass spectrometer of the present invention makes it possible to perform the mass spectrometry with a high detection limit without increase of the background in a mass spectrum, even when a space with a pressure of $1\times10^{-2}$ Pa or higher is measured. In addition, since the ion detector 31 of the present invention has a simple configuration, it is possible to provide a mass spectrometer capable of performing partial pressure measurement with a high precision, while preventing the increase in costs required for maintenance and manufacturing.

The present invention is not limited to the above-described embodiments, and can be modified, as appropriate, within a range not departing from the gist of the present invention. For example, the block plates 41 and 52 added to the Faraday electrode 33 in the above-described embodiments are flat plate-shaped members. However, the block plates 41 and 52 are not limited thereto, but may have curved surfaces. In addition, a yoke may be added to the permanent magnets 42 attached to the sides of the block plate 41. In addition, in the above-described embodiments, the cases where the measurement target to which the mass spectrometer 1 is attached is a sputtering apparatus are described. However, the measurement target is not limited thereto. The mass spectrometer of the present invention may be used not only for film formation apparatuses such as vacuum vapor deposition apparatuses and CVD apparatuses, but also for various vacuum apparatuses such as dry etching apparatuses and surface modification apparatuses.

What is claimed is:

1. A mass spectrometer, comprising:

an ionization unit configured to ionize an analyte gas;

a filter unit configured to allow passage of only a target ion which is a component of the analyte gas ionized in the ionization unit and which has a specific mass-to-charge ratio; and an ion detection unit configured to detect an ion detection value based on the target ion having passed through the filter unit, wherein the ion detection unit comprises:

a Faraday electrode, comprising:

an electrode portion disposed along a direction of a centerline of the filter unit; and a bottom electrode provided at a position downstream of the electrode portion in a flow of the target ion so as to intersect with the centerline, the electrode portion and the bottom electrode being connected to each other, a secondary electron multiplier provided to face the electrode portion with the centerline located therebetween, and a blocking portion connected to the bottom electrode and configured to block a photoelectron and reflected light traveling toward the secondary electron multiplier.

2. The mass spectrometer according to claim 1, wherein a height of the blocking portion is 10 or less times a distance between the blocking portion and a position which is on a periphery of an irradiated area where the bottom electrode is irradiated with vacuum ultraviolet light generated upon ionization of the analyte gas and which is most distant from the blocking portion.

3. The mass spectrometer according to claim 1, wherein a position at which the blocking portion and the bottom electrode are connected to each other is set at a boundary of an irradiated area where the bottom electrode is irradiated with vacuum ultraviolet light generated upon ionization of the analyte gas.

4. The mass spectrometer according to claim 1, wherein the ion detection unit further comprises another blocking portion provided on the bottom electrode to face the blocking portion with the centerline located therebetween.

5. The mass spectrometer according to claim 1, comprising a returning portion provided to the blocking portion and projecting toward the centerline.

6. The mass spectrometer according to claim 1, comprising a returning portion provided to the Faraday electrode on a blocking portion side and projecting toward the centerline.

7. The mass spectrometer according to claim 1, wherein the ion detection unit further comprises a magnet unit having magnetic lines of force that pass across a space between the blocking portion and the Faraday electrode.

8. The mass spectrometer according to claim 7, wherein the magnetic lines of force of the magnet unit pass in parallel with a blocking surface of the blocking portion in such a direction that the secondary electron multiplier is located on a left side of the magnetic lines of force in a top view from a side of the filter unit.

9. The mass spectrometer according to claim 8, wherein a height of the blocking portion is 1.5 to 3 times a distance between the blocking portion and a position which is on a periphery of an irradiated area where the bottom electrode is irradiated with vacuum ultraviolet light generated upon ionization of the analyte gas and which is most distant from the blocking portion.

10. The mass spectrometer according to claim 1, wherein a portion of the filter unit or the blocking portion to be irradiated with vacuum ultraviolet light is colored in black, while retaining electrical conductivity.

* * * * *